United States Patent [19]

Stievenart

[11] 4,351,518

[45] Sep. 28, 1982

[54] SUCTION-OPERATED DEVICE FOR FEEDING SHEETS ONE BY ONE TO A POINT OF UTILIZATION

[76] Inventor: Emile Stievenart, c/o Matrix Instruments Inc., 230 Pegasus Ave., Northvale, N.J. 07647

[21] Appl. No.: 216,842

[22] Filed: Dec. 16, 1980

[51] Int. Cl.[3] ..... B65H 3/08

[52] U.S. Cl. ..... 271/90; 221/211; 294/64 R; 414/121; 198/486; 198/689

[58] Field of Search ..... 271/90, 107, 103, 98, 271/102, 108, 104, 194, 195; 221/211; 414/744 B, 752, 737, 627, 121; 294/64 R; 198/486, 689

[56] References Cited

U.S. PATENT DOCUMENTS

| | | | |
|---|---|---|---|
| 1,367,528 | 2/1921 | Anderson et al. | 271/107 |
| 2,840,270 | 6/1958 | Gore | 221/211 |
| 3,820,667 | 6/1974 | Critchlow et al. | 414/627 |

FOREIGN PATENT DOCUMENTS

| | | | |
|---|---|---|---|
| 534081 | 9/1931 | Fed. Rep. of Germany | 271/90 |
| 1427168 | 12/1965 | France | 221/211 |

*Primary Examiner*—Bruce H. Stoner, Jr.
*Attorney, Agent, or Firm*—Bauer & Amer

[57] ABSTRACT

A pick-up device operated by a suction applied by a partially compressed bellows such that release of the suction attachment thereto can be effectively and readily achieved by a slight further compression of the bellows; said further compression providing a pulse of pressure air which releases or neutralizes the suction.

3 Claims, 4 Drawing Figures

SUCTION-OPERATED DEVICE FOR FEEDING SHEETS ONE BY ONE TO A POINT OF UTILIZATION

The present invention relates generally to a suction-operated pick-up or individual sheet feeding device, and more particularly to an improved construction and operational mode thereof which greatly facilitates release of the suction grip thereof, all as is more particularly subsequently described in detail herein.

Suction-operated pick-ups for individual sheets or the like are well known, one such device being described and illustrated in U.S. Pat. No. 3,702,698. The referred to suction-operated device and other such known devices use as a source of vacuum a vacuum pump or the like so that when needed, a vacuum is readily applied for lifting purposes and, perhaps equally important, when release is required this condition can be readily achieved by merely terminating the operation of the vacuum pump. While as just noted effective control over the application and release of the suction is achieved by corresponding control of the operation and non-operation of the vacuum pump, or its equivalent, this approach has the unavoidable expense and complexity occasioned by requiring the use of a vacuum pump.

Broadly, it is an object of the present invention to provide a suction-operated device not requiring the use of a vacuum pump or other such complex component, and in other respects as well overcoming the foregoing and other shortcomings of the prior art. More particularly, it is an object to provide a bellows-applied suction for lifting purposes in the within pick-up, and to advantageously utilize the required movements of the pick-up into and away from the pick-up station to operate said bellows to both apply and release its suction.

An improved suction-operated device for feeding sheets one by one to a point of utilization demonstrating objects and advantages of the present invention includes a feed screw powered in rotation and having an operative member in threaded engagement thereon such that said member is effectively urged in opposite descending and ascending directions along the rotation axis of the feed screw depending upon its direction of rotation. A cooperating arrangement of a front, a rear, and side walls is provided adjacent the leading end of the operative member and cooperates to bound a compartment. From said compartment a suction cup projects in facing relation to a supply stack of materials disposed in the path of movement of the operative member. Completing the within pick-up or device is a bellows disposed in said compartment in an interposed position between the suction cup and the feed screw. Thus, during descending movement, the rear compartment wall partially compresses the bellows and results in the suction attachment of the suction cup to the top sheet of the supply stack, and during subsequent ascending movement, the front compartment wall lifts the suction cup and there then results in a further compression of the bellows when the bellows is forced against the end of the feed screw. This further compression of the bellows results in the release of the sheet from the suction cup, and permits its delivery to a point of utilization.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIGS. 1–4, inclusive, are side elevational views, in section, illustrating the inventive device hereof in the process of feeding sheets one by one to a point of utilization. More particularly, FIG. 1 illustrates the device at the beginning of a feeding cycle wherein the suction cup thereof is in a clearance position in facing relation to a supply stack of sheets incident to being urged through movement into contact therewith;

Figure 1:
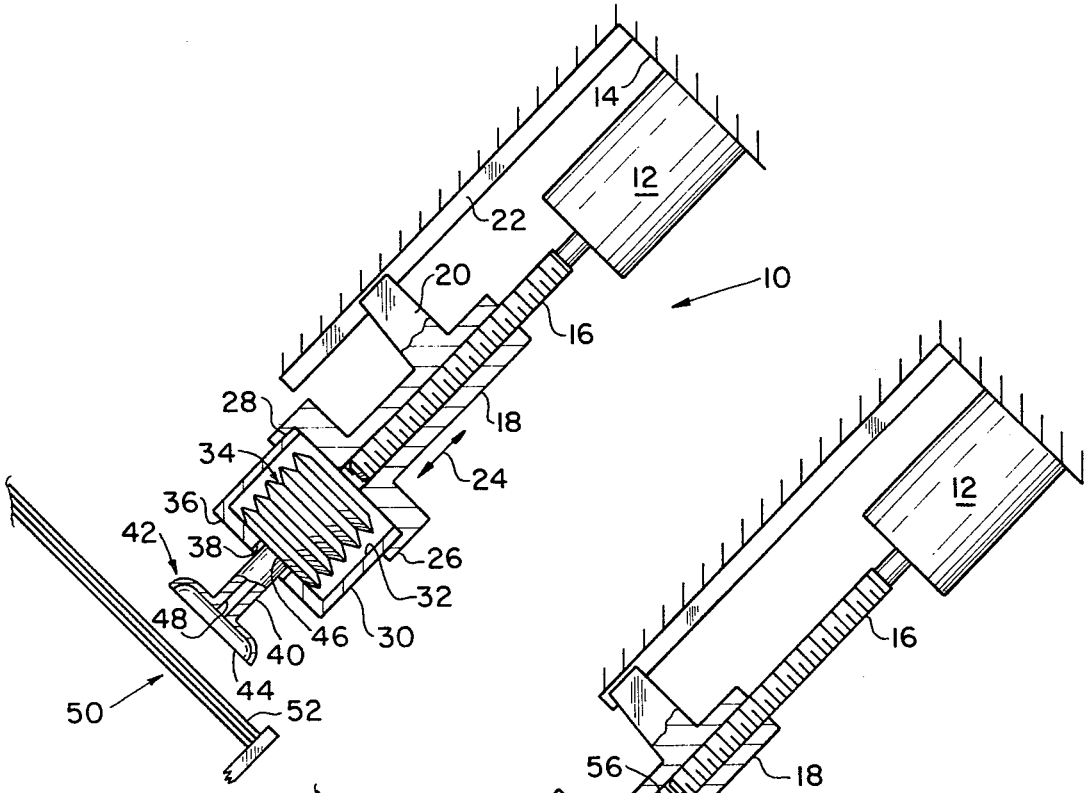

In the drawings the illustrations of the within inventive device has been greatly simplified. The reason is that the simplification assists, rather than detracts, from focusing on the inventive structural features. In this regard, and as may be readily understood from prior U.S. Pat. No. 3,702,698, there are known devices which are suction-operated and are capable of feeding sheets one by one to a point of utilization. In all such known devices a vacuum is applied to the contact surface of a suction cup, such as suction cup 6 of said U.S. Pat. No. 3,702,698 and, as a result, the suction cup is able to lift a sheet from a supply stack, one by one, preparatory to the delivery thereof to a point of utilization. In the referred to prior art devices, however, release of the sheet from the suction cup is achieved by discontinuing or terminating the vacuum. In other words, the operational mode of known devices in the classification noted requires operative connected to a vacuum source, such as a vacuum pump, wherein the vacuum can be applied when needed and discontinued when not needed.

In contrast to the foregoing, the within inventive suction-operated device utilizes a bellows, rather than a vacuum pump or the like. To a great extent this is possible because the operational mode of the within inventive device, as well be described in detail subsequently, does not require terminating or releasing the suction by which the suction cup lifts the sheet from the supply stack but requires only further compression of the bellows to effectuate release of the sheet. Stated another way, since release of the suction is not required to correspondingly release the sheet from the suction cup, it is therefore not required to have a vacuum pump or to use a mechanically equivalent device to apply suction which, as understood, can then be readily made to release its suction merely by terminating the operation thereof.

Referring now to the drawings, the within inventive device, generally designated 10, includes any one of many commercially available reversible electric motors 12 appropriately mounted on a support surface 14. Operatively arranged to be powered in rotation by motor 12 is a feed screw 16. Threadably engaged on the feed screw 16 is one part of an operative member 18 which has a laterally extending spline 20 which it will be understood extends into a groove 22 and which, as further understood, thus prevents member 18 from turning in rotation with the rotating feed screw 16. Thus, as a result, member 18 is urged through descening or ascending movement along feed screw 16, illustrated by the double arrow 24, depending upon the direction of rotation of the feed screw 16. The movement path 24 also can be characterized as being along the rotation axis of the feed screw 16.

Attached to a circular lip 26 at the leading end of member 18, either by a friction fit or by being threadably engaged thereto, as at 28, is a cup-like member 30 which, in conjunction with said cylindrical lip 26 cooperates to bound an internal compartment 32. Prior to the assembly of cup 30 to the leading end of member 18 is it contemplated that there will be disposed within the compartment 32 a conventional compressible bellows 34 of well understood contruction and which may be any one of many commercially available types conventionally used to apply suction when compressed, and thus when the internal volume thereof is diminished against a spring urgency tending to maintain the bellows in its initial uncompressed condition and size.

In a central location of the cup front wall 36 is an over-sized opening 38 through which is projected a stem 40 of a suction cup, generally designated 42 which, as understood, also includes an elastomeric gripping surface 44. More particularly, and as is well understood, the suction cup stem 40 is appropriately connected, as at 46, so as to have communication with the interior chamber of the bellows 34 and itself has a passageway 48 in communication with the sheet-engaging or gripping surface 44. As a result, and again as is well understood, initial compression of the bellows 34 forces air through the passage 48 and when the bellows is subsequently released the bias of its construction, which urges it to return to its original dimension, is then effective to apply a vacuum through the passageway 48 and thus at the gripping surface 44. If the gripping surface 44 is then in contact with a liftable object the result will be a suction-induced attachment of the object to the surface 44 preparatory to the removal thereof.

Figure 2:
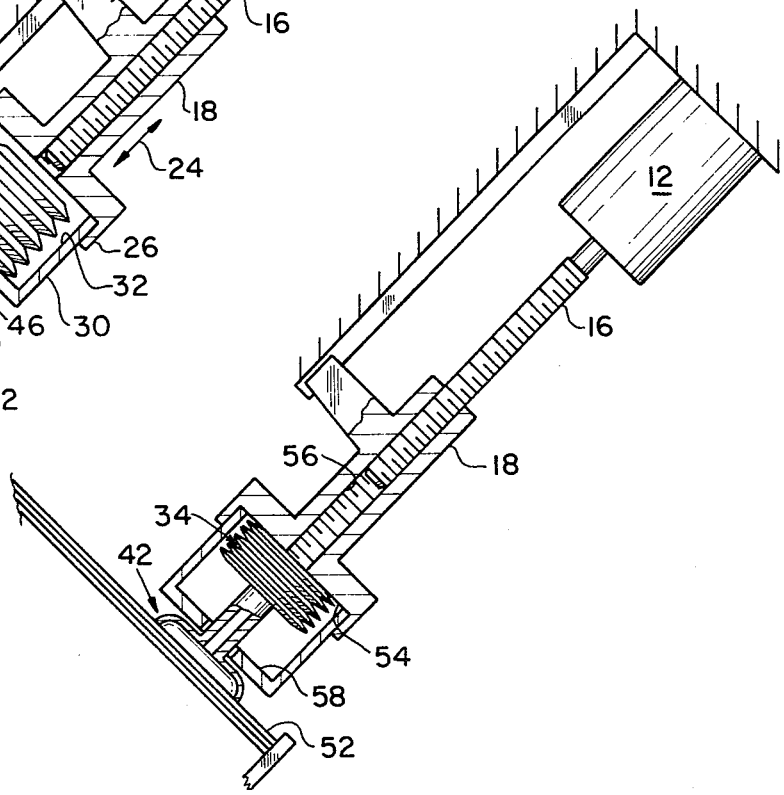
FIG. 2 illustrates the suction cup in contact against said supply stack and the conditions under which a suction is applied at the interface between said suction cup and said sheet in contact therewith for lifting purposes.

In accordance with the present invention, and as may best be appreciated by progressive examination of FIGS. 1 and 2, the operational mode of the device 10 hereof contemplates rotation of feed screw 16 in a direction which results in descending movement of member 18 along path 24. Situated at the end of path 24 is a supply stack 50 of what can be assumed to be sheets of paper or the like, the uppermost positioned sheet thereof being sheet 52 which is in facing relationship to and is generally perpendicularly oriented in relation to the movement path 24. The point in the operation of device 10 specifically illustrated in FIG. 2 is that at which the suction cup 42 comes into physical contact with the sheet 52 and the rear wall 54 which is part of the member 18 which also bounds the compartment 32, is then effective in causing compression of the bellows 34 in response to descending movement of member 18 as caused by continued rotation of the feed screw 16. When referring to FIG. 2 it should be noted of course that there is no movement of the feed screw 16 along path 24 and that the end of feed screw 16 in said figure is at the same location it occupies as illustrated in FIG. 1. The draftsman's convention for threads illustrated in FIG. 2 and designated 56 therein thus designates the threads which are provided along the central through bore of the member 18 and therefore should not be confused as being any part of the feed screw 16.

Figure 3:
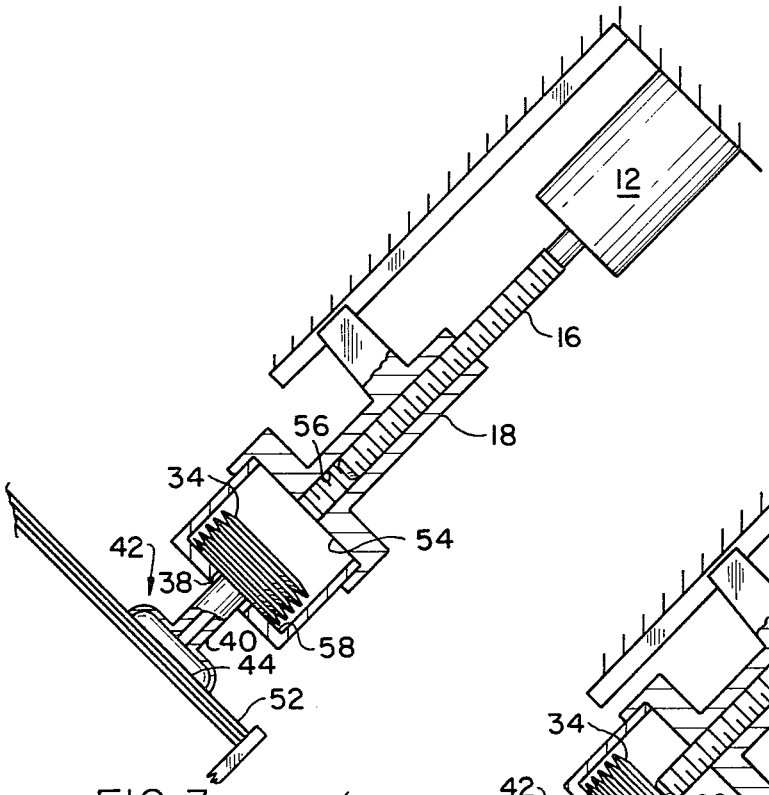
FIG. 3 illustrates the device incident to the actual lifting removal of said sheet from said supply stack.

Using any appropriate control, such as a pressure switch or the like (not shown), it will be understood that after attainment of the situation depicted in FIG. 2 that the rotational direction of motor 12 is reversed and member 18 is correspondingly urged through ascending movement along the feed screw 16. As is perhaps best illustrated in FIG. 3, this results in the wall surface 54 easing off of the bellows 34 and the urgency in the bellows to expand then effectively applying a vacuum through passageway 48 and along the gripping surface 44 to thereby result in a suction-induced attachment of sheet 52 to the suction cup gripping surface 44. Ascending movement of member 18 of course also results in ascending movement of the compartment front wall 58 along the stem 40, this relative movement being readily permitted by the overize in the opening 38 in relation to the diameter of the stem 40. Eventually, and as illustrated in FIG. 3, the compartment from wall 58 engages the underside of the bellows 34 and is thus effective in response to continued ascending movement in lifting the suction cup 42 with sheet 52 attached thereto to a clearance position from the supply stack 50.

Figure 4:
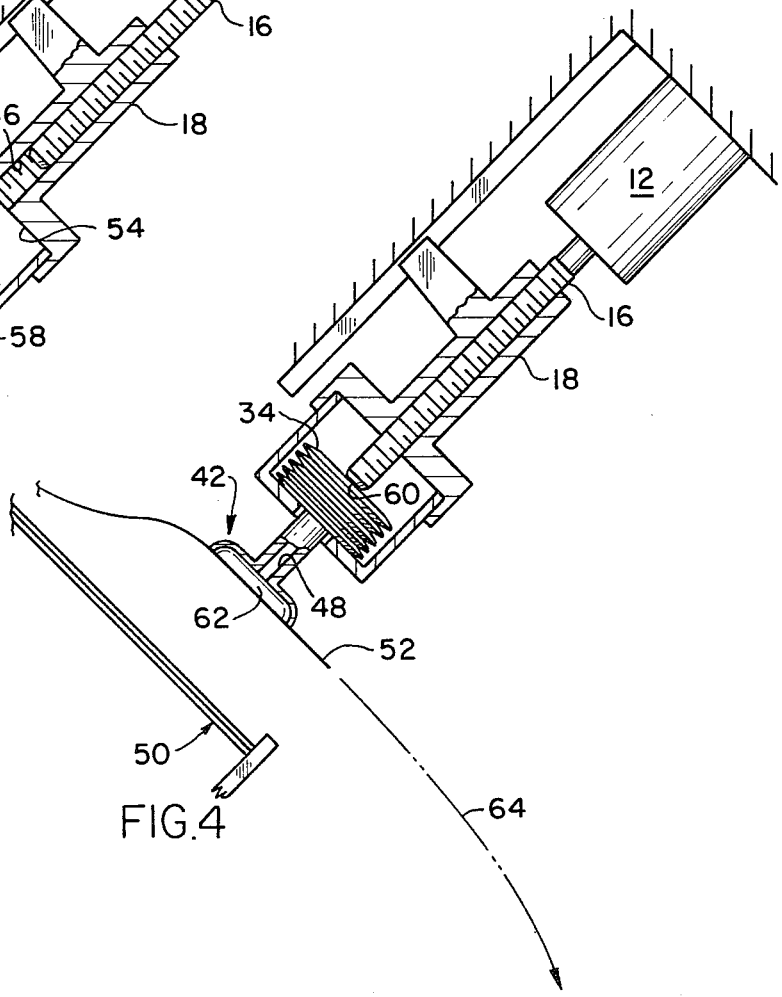
FIG. 4 illustrates the lifting of said sheet and the conditions which result in the detachment of said sheet from said device and its delivery to a point of utilization.

Eventually the situation occurs as is depicted in FIG. 4 at which member 18 ascends to that point along the "axially" stationary feed screw 16 where the feed screw end 60 makes contact with the partially compressed bellows 34. The within invention contemplates further ascending movement in the member 18 which then results in a slight further compression of the bellows 34. This further compression of course results in a pulse of air being transmitted through the passage 48 and thus into the sealed area 62 which is under the previously described induced suction. The pulse of air of course neutralizes the suction or, to state it somewhat differently, causes the release of the suction engagement established between the suction cup 42 and the sheet 52. In response to this release, sheet 52 of course detaches itself from the suction cup 42 and is expected to fall along a generally vertically oriented path 64 to a point of utilization. Since the device 10 hereof is set at an angle to the supply stack 50 the path 64 is one which will not result in the re-deposit of the sheet 52 back upon the supply stack 50. In other ways as well appropriate means can be provided to effectively cause the sheets picked up one by one by the device 10, as herein described, to be effectively delivered to a point of utilization.

For completeness' sake it is noted that one intended use of the suction-operated device 10 hereof is in connection with a so-called video imager commercially available from Matrix Instruments Inc. of Northvale, N.J. In the end use referred to, the pick-up 10 will be used to transport sheets of film, one by one, from a supply stack to a photography station for photographing use thereof. While the use just generally described is preferred, it is of course not limited thereto. In other respects as well, a latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved suction-operated device for feeding sheets one by one to a point of utilization comprising a feed screw powered in rotation, an operative member in threaded engagement on said rotating feed screw operatively arranged to be urged in opposite descending and ascending directions along the rotation axis of said feed screw depending upon the direction of rotation thereof, a cooperating arrangement of a front, a rear, and side walls located adjacent the leading end of said operative member bounding a compartment, a suction cup operatively arranged to be projected from said compartment in facing relation to a supply stack of materials disposed in the path of movement of said operative member, and a bellows disposed in said compartment in an interposed position between said suction cup and said feed screw, whereby during said descending movement said rear compartment wall partially compresses said bellows and results in the suction attachment of said suction cup to a sheet of said supply stack and during said ascending movement said front compartment wall lifts said suction cup and results in a further compression of said bellows against said feed screw and thus the release of said sheet from the suction cup.

2. An improved suction-operated device for feeding sheets one by one to a point of utilization as claimed in claim 1 wherein said path of movement along said feed screw rotation axis is established at an angle to the horizontal, whereby said released sheet falling in a vertical direction will not be along a path likely to result in the deposit thereof back on said supply stack.

3. An improved suction-operated device for feeding sheets one by one to a point of utilization as claimed in claim 2 wherein said suction cup and bellows are an integral assembly in which the changeable volume of said bellows is in communication with a lifting surface of said suction cup so as to create a suction at said lifting surface incident to causing the attachment thereof of said sheet and also to release an air pulse thereat incident to causing the detachment therefrom of said sheet.

* * * * *